US005284575A

United States Patent [19]

Owen

[11] Patent Number: 5,284,575

[45] Date of Patent: Feb. 8, 1994

[54] PROCESS FOR FAST FLUIDIZED BED CATALYST STRIPPING

[75] Inventor: Hartley Owen, Belle Mead, N.J.

[73] Assignee: Mobil Oil Corporation, Fairfax, Va.

[21] Appl. No.: 949,925

[22] Filed: Sep. 24, 1992

[51] Int. Cl.[5] ..... C10G 11/18; C10G 35/14

[52] U.S. Cl. ..... 208/161; 208/113; 208/120; 208/150; 208/164

[58] Field of Search ..... 208/164, 153, 163, 153, 208/113, 150, 120, 161

[56] References Cited

U.S. PATENT DOCUMENTS 4,921,596 6/1989 Chou et al. ..... 208/164

*Primary Examiner*—Mark L. Bell
*Assistant Examiner*—Bekir L. Yildirim
*Attorney, Agent, or Firm*—Alexander J. McKillop; Malcolm D. Keen; Richard D. Stone

[57] ABSTRACT

A fluidized catalytic cracking process operates with a turbulent or fast fluidized bed (FFB) spent catalyst stripper. Higher vapor velocities in the stripper improve stripping. Preferably spent catalyst is added to the stripper via cyclone diplegs. Preferably most of the spent catalyst is added into the bed near the top of the FFB stripper is removed via the top of the stripper, to a contiguous, annular bubbling dense bed stripper surrounding the FFB stripper. Some catalyst may be removed from the base of the FFB stripper.

19 Claims, 3 Drawing Sheets

PROCESS FOR FAST FLUIDIZED BED CATALYST STRIPPING

BACKGROUND OF THE INVENTION

1. FIELD OF THE INVENTION

The field of the invention is the fluidized catalytic cracking process in general and catalyst stripping in particular.

2. DESCRIPTION OF RELATED ART

Catalytic cracking is the backbone of many refineries. It converts heavy feeds into lighter products by catalytically cracking large molecules into smaller molecules. Catalytic cracking operates at low pressures, without hydrogen addition, in contrast to hydrocracking, which operates at high hydrogen partial pressures. Catalytic cracking is inherently safe as it operates with very little oil actually in inventory during the cracking process.

There are two main variants of the catalytic cracking process: moving bed and the far more popular and efficient fluidized bed process.

In the fluidized catalytic cracking (FCC) process, catalyst, having a particle size and color resembling table salt and pepper, circulates between a cracking reactor and a catalyst regenerator. In the reactor, hydrocarbon feed contacts a source of hot, regenerated catalyst. The hot catalyst vaporizes and cracks the feed at 425° C.-600° C., usually 460° C.-560° C. The cracking reaction deposits carbonaceous hydrocarbons or coke on the catalyst, thereby deactivating the catalyst. The cracked products are separated from the coked catalyst. The coked catalyst is stripped of volatiles, usually with steam, in a catalyst stripper and the stripped catalyst is then regenerated. The catalyst regenerator burns coke from the catalyst with oxygen containing gas, usually air. Decoking restores catalyst activity and simultaneously heats the catalyst to, e.g., 500° C.-900° C., usually 600° C.-750° C. This heated catalyst is recycled to the cracking reactor to crack more fresh feed. Flue gas formed by burning coke in the regenerator may be treated for removal of particulates and for conversion of carbon monoxide, after which the flue gas is normally discharged into the atmosphere.

Catalytic cracking is endothermic, it consumes heat. The heat for cracking is supplied at first by the hot regenerated catalyst from the regenerator. Ultimately, it is the feed which supplies the heat needed to crack the feed. Some of the feed deposits as coke on the catalyst, and the burning of this coke generates heat in the regenerator, which is recycled to the reactor in the form of hot catalyst.

Catalytic cracking has undergone progressive development since the 40s. The trend of development of the FCC process has been to all riser cracking and zeolite catalysts.

Riser cracking gives higher yields of valuable products than dense bed cracking. Most FCC units now use all riser cracking, with hydrocarbon residence times in the riser of less than 10 seconds, and even less than 5 seconds.

Zeolite based catalysts of high activity and selectivity are now used in most FCC units. These catalysts work best when coke on the catalyst after regeneration is less than 0.1 wt %, and preferably less than 0.05 wt %.

To regenerate FCC catalysts to low residual carbon levels, and to burn CO completely to CO2 within the regenerator (to conserve heat and minimize air pollution) many FCC operators add a CO combustion promoter to the catalyst or to the regenerator.

U.S. Pat. No. 4,072,600 and U.S. Pat. No. 4,093,535, which are incorporated by reference, teach use of combustion-promoting metals such as Pt, Pd, Ir, Rh, Os, Ru and Re in cracking catalysts in concentrations of 0.01 to 50 ppm, based on total catalyst inventory.

As the process and catalyst improved, refiners attempted to use the process to upgrade poorer quality feeds, in particular, feedstocks that were heavier, and had more metals and sulfur.

These heavier, dirtier feeds pushed the regenerator, and exacerbated four existing problem areas in the regenerator, sulfur, steam, temperature and NOx. These problems will each be reviewed in more detail below.

SULFUR

Much of the sulfur in the feed ends up as Sox in the regenerator flue gas. Higher sulfur feed, and complete CO combustion in the regenerator, increase the Sox content of the flue gas. Some attempts were made to minimize the amount of SOx discharged to the atmosphere by including catalyst additives to capture SOx in the regenerator. These additives pass with the regenerated catalyst back to the FCC reactor where the reducing atmosphere releases the sulfur compounds as H2S. Suitable agents are described in U.S. Pat. Nos. 4,071,436 and 3,834,031. Use of cerium oxide for this purpose is shown in U.S. Pat. No. 4,001,375.

Unfortunately, the conditions in most FCC regenerators are not the best for SOx adsorption. The high temperatures in modern FCC regenerators (up to 870° C. (1600° F.)) impair Sox adsorption. One way to minimize SOx in flue gas is to pass catalyst from the FCC reactor to a long residence time steam stripper, as in U.S. Pat. No. 4,481,103 Krambeck et al which is incorporated by reference. This process steam strips spent catalyst at 500°-550° C. to remove some undesirable sulfur- or hydrogen-containing components, but considerable capital expense is involved.

STEAM

Steam is known to cause catalyst deactivation. Steam is not intentionally added, but is invariably present, usually as adsorbed or entrained steam from steam stripping or catalyst or as water of combustion formed in the regenerator.

Poor stripping leads to a double dose of steam in the regenerator, first from the adsorbed or entrained steam and second from hydrocarbons left on the catalyst due to poor catalyst stripping. Catalyst passing from the FCC stripper to the regenerator contains hydrogen-containing components, such as coke or unstripped hydrocarbons adhering thereto. This hydrogen burns in the regenerator to form water and cause hydrothermal degradation.

U.S. Pat. No. 4,336,160 to Dean et al, which is incorporated by reference, attempts to reduce hydrothermal degradation by staged regeneration. However, the flue gas from both stages of the regenerator contains Sox which is difficult to clean. It would be beneficial, even in staged regeneration, if the amount of water precursors present on stripped catalyst was reduced.

Steaming is more of a problem as regenerators get hotter. Higher temperatures accelerate the deactivating effects of steam.

TEMPERATURE

Regenerators are operating at higher temperatures. This is because most FCC units are heat balanced, that is, the endothermic heat of the cracking reaction is supplied by burning the coke deposited on the catalyst. With heavier feeds, more coke is deposited on the catalyst than is needed for the cracking reaction. The regenerator runs hotter, so the extra heat may be rejected as high temperature flue gas. Many refiners limit the amount of resid or high CCR feeds to that amount which can be tolerated by the unit. High temperatures are a problem for the metallurgy of many units, but more importantly, are a problem for the catalyst. In the regenerator, the burning of coke and unstripped hydrocarbons leads to much higher surface temperatures on the catalyst than the measured dense bed or dilute phase temperature. This is discussed by occelli et al in Dual-Function Cracking Catalyst Mixtures, Ch. 12, Fluid Catalytic Cracking, ACS Symposium Series 375, American Chemical Society, Washington, D.C., 1988.

Some regenerator temperature control is possible by adjusting the CO/CO2 ratio in the regenerator. Burning coke partially to CO produces less heat than complete combustion to CO2. However, in some cases, this control is insufficient, and also leads to increased CO emissions, which can be a problem unless a CO boiler is present.

The prior art also used dense or dilute phase regenerator heat removal zones or heat-exchangers remote from, and external to, the regenerator to cool hot regenerated catalyst for return to the regenerator. Such approaches help, but I wanted to reduce the amount of unstripped hydrocarbons burned in the regenerator, rather than deal with unwanted heat release in the regenerator.

NOX

Burning nitrogenous compounds in FCC regenerators has long led to creation of minor amounts of NOx emitted with the regenerator flue gas, or associated with a downstream CO boiler. Usually these emissions were not much of a problem because of relatively low temperatures.

Many FCC units now operate at higher temperatures, with a more oxidizing atmosphere, and use CO combustion promoters such as Pt. These changes in regenerator operation which reduce CO emissions, usually increase nitrogen oxides (NOx) emissions. It is difficult in a catalyst regenerator to completely burn coke and CO in the regenerator without increasing the NOx content of the regenerator flue gas, so NOX emissions are now frequently a problem. Higher regenerator temperatures, due in part to burning of potentially strippable hydrocarbons in the regenerator contributes to the Nox problem.

It would be beneficial if a better stripping process were available which would increase recovery of valuable, strippable hydrocarbons. There is a special need to remove more hydrogen from spent catalyst to minimize hydrothermal degradation in the regenerator. It would be further advantageous to remove more sulfur-containing compounds from spent catalyst prior to regeneration to minimize Sox in the regenerator flue gas. Also, it would be advantageous to have a way to reduce to some extent regenerator temperature.

Although much work has been one on better stripping designs, there are still many shortcomings. I realized that the most significant problem was trying to achieve efficient stripping in a bubbling dense bed.

Although it might seem easy to increase the superficial vapor velocity in a stripper, by increasing the stripping steam rate, and improve stripping, in practice this is not possible. simply increasing the stripping steam usually improves stripping, but in many units the net effect is to send much of the increased stripping steam into the regenerator. Simply increasing steam rates may result in dilute phase transport of spent catalyst into the regenerator. Stripping is improved, but primarily because of better settling or dearation of spent catalyst within or just above the stripper.

The catalyst strippers commonly used are somewhat undersized anyway, and it becomes harder to get a given catalyst traffic down through the stripper if the stripper must also accommodate an increased volume of stripping steam. The situation may get worse if attempts are made to improve stripping by heating spent catalyst with hot regenerated catalyst. The heating improves stripping, but the increased catalyst traffic can degrade stripping efficiency to some extent.

An additional problem is that many reactor vessels and reactor outlet cyclones are designed to operate with a catalyst traffic associated with a given superficial vapor velocity from the stripper. Increasing stripping steam rates in some units could produce an unacceptable amount of catalyst entrainment into the dilute phase regions of the vessel holding the riser outlet.

I have now found a way to achieve much better stripping of coked FCC catalyst. My solution not only improves stripping, and increases the yield of valuable liquid product, it reduces the load placed on the catalyst regenerator, minimizes Sox emissions, and permits processing of more difficult feeds. Regenerator temperatures can be increased, reduced, or maintained constant while processing worse feeds, while the amount of hydrothermal deactivation of catalyst in the regenerator can be reduced.

I was able to overcome most deficiencies of current spent catalyst strippers by adopting a new approach to stripping, and achieving most of the stripping, and preferably all, in-a fast fluidized bed stripper. I developed a new process and apparatus which allows fast fluidized bed stripping to be conducted in FCC units operating with riser reactors, and with the stripper beneath, and completely or partially disposed about, the riser reactor.

My process greatly reduces the need for increased catalyst traffic, as by direct contact heating of spent catalyst with regenerated catalyst, and improves the operation of those strippers operating with such increased catalyst traffic.

Surprisingly, fast fluidized bed stripping can be achieved, with little or no increase in catalyst traffic in the upper portions of the dilute phase of the reactor vessel into which the riser reactor discharges.

BRIEF SUMMARY OF THE INVENTION

Accordingly, the present invention provides a fluidized catalytic cracking process wherein a heavy hydrocarbon feed comprising hydrocarbons having a boiling point above about 650° F. is catalytically cracked to lighter products by contact with a circulating fluidizable catalytic cracking catalyst inventory consisting of particles having a size ranging from about 20 to about 100 microns, and fines, cracked catalyst particles having a smaller particle size, comprising: catalytically cracking said feed in a catalytic cracking reactor operating at catalytic cracking conditions by contacting feed with a source of regenerated catalyst to produce a cracking reactor effluent mixture comprising cracked products and spent catalyst containing coke and strippable hydrocarbons; separating said effluent mixture in a separation means into a cracked product rich vapor phase and a solids rich phase comprising spent catalyst; discharging at least 80% of said solids rich phase down into a stripping means having an opening and opening cross sectional area at a top portion thereof for admission of spent catalyst and an opening at a base portion thereof for stripping gas, said stripping means operating at stripping conditions including a superficial vapor velocity above 3.0 fps and sufficient to displace at least a majority of solids discharged down into said stripping zone back up from said stripping zone into a bubbling bed, stripped catalyst transport region alongside of said FFB stripping means, to produce a stripper vapor phase which is discharged up from said FFB stripping means with said solids discharged up from said stripping zone, and stripped catalyst, at least a majority of which is discharged up from said stripping zone; transporting said stripped catalyst via said transport region to a catalyst regeneration means; regenerating said stripped catalyst in a catalyst regeneration means to produce regenerated catalyst; and recycling said regenerated catalyst to said catalytic cracking reactor.

In another embodiment, the present invention provides a fluidized catalytic cracking process wherein a heavy hydrocarbon feed comprising hydrocarbons having a boiling point above about 650 F. is catalytically cracked to lighter products by contact with a fluidizable catalytic cracking catalyst consisting of particles having a size ranging from about 20 to about 100 microns, and fines and cracked catalyst particles having a smaller particle size, comprising: catalytically cracking said feed in a riser catalytic cracking reactor operating at catalytic cracking conditions by contacting feed with a source of regenerated catalyst in the base of said riser reactor and discharging from a top portion of said riser reactor cracked products and spent catalyst containing coke and strippable hydrocarbons into a riser cyclone separation means within a vessel and connective with said riser outlet; separating said effluent mixture in said riser cyclone means into a cracked product rich vapor phase and a solids rich phase comprising spent catalyst and strippable hydrocarbons which is discharged down via a cyclone dipleg means sealed by immersion within a fast fluidized bed stripping means; fast fluidized bed (FFB) stripping of said spent catalyst and strippable hydrocarbons discharged from said riser cyclone dipleg means-in a FFB stripping means within said vessel and beneath said riser cyclone means and encompassing said riser cyclone dipleg means, at FFB stripping conditions including sufficient stripping steam to generate a superficial vapor velocity above 3.0 fps, and sufficient to both strip spent catalyst and displace at least 50 wt % of the spent catalyst discharged via said dipleg means from said FFB stripping means up and over from said FFB stripping means into a bubbling bed stripping means alongside of said FFB stripping means, and produce a FFB stripper vapor phase which is discharged up from said FFB stripping means with said displaced, stripped catalyst, at a superficial vapor velocity at a top portion of said FFB stripper of at least 3.0 fps; a FFB stripped catalyst product, consisting of at least 50 wt % of said spent catalyst, which is discharged up from said FFB stripping means and which overflows into said bubbling bed stripping means; bubbling bed stripping of stripped catalyst discharged up from said FFB stripping means at bubbling bed stripping conditions including a superficial vapor velocity below 2.5 fps to produce a stream of catalyst which has been stripped at both FFB stripping conditions and at bubbling bed stripping conditions, which is discharged down from said bubbling bed stripping means via a bubbling bed stripper lower outlet; combining in a shared vapor region above said FFB stripping means and said bubbling bed stripping means vapors from said stripping means and passing said combined stripper vapors through an enlarged region of said vessel above said stripping means, having an increased cross sectional area for flow sufficient to reduce the superficial vapor velocity of the combined streams to below 2.0 fps, and combining in said upper portion of said vessel stripper vapors and cracked product vapor; regenerating stripped catalyst removed from the bottom of said bubbling bed stripper in a catalyst regeneration means to produce regenerated catalyst; and recycling said regenerated catalyst to said catalytic cracking reactor.

In an apparatus embodiment, the present invention provides an apparatus for the fluidized catalytic cracking of a hydrocarbon feed comprising a riser catalytic cracking reactor means having an inlet in a base portion thereof connective with a source of feed and with a source of regenerated catalyst and an outlet in an upper portion within a cylindrical vessel, said outlet discharging cracked products and spent cracking catalyst containing coke and strippable hydrocarbons, and said cylindrical vessel having an upper portion having a cross sectional area containing said riser outlet and a lower portion having a cross sectional area with a reduced cross sectional area relative to said upper portion; a cyclone separator within said vessel connected to said riser reactor outlet for producing a cracked product rich vapor phase and a solids rich phase of spent catalyst and strippable hydrocarbons which is discharged down via a cyclone dipleg; a FFB stripping means having an upper inlet/outlet having a cross sectional area and within said vessel and beneath and receiving said cyclone dipleg; a lower inlet for stripping gas; and a lower outlet for stripped solids; a stripped catalyst transport means for transferring catalyst discharged from said upper inlet/outlet and from said lower outlet of said FFB stripping means to a catalyst regeneration means; a catalyst regeneration means having a stripped catalyst inlet connective with said transport means; a regeneration gas inlet; a flue gas outlet, and an outlet for removal of regenerated catalyst; and a catalyst recycle means connective with said outlet of said catalyst regeneration means and said catalyst inlet of said cracking reactor.

DETAILED DESCRIPTION

DESCRIPTION OF PREFERRED EMBODIMENTS

Figure 1:
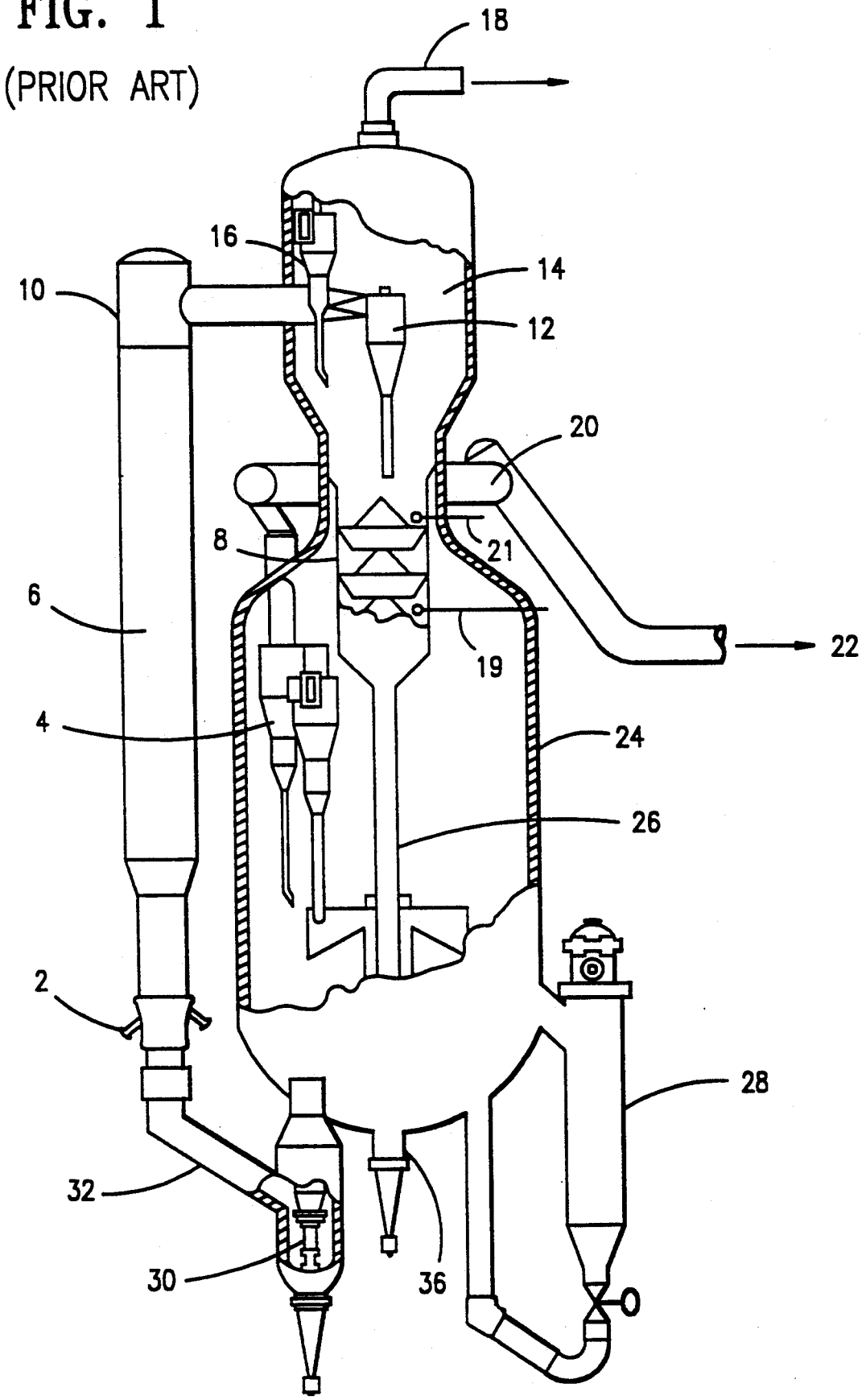
FIG. 1 (PRIOR ART)
FIG. 1 (Prior Art) shows a simplified schematic view of an FCC unit with a conventional stripper.

FIG. 1 is a simplified schematic view of an FCC unit of the prior art, similar to the Kellogg Ultra Orthoflow converter Model F shown as FIG. 17 of Fluid Catalytic Cracking Report, in the Jan. 8, 1990 edition of Oil & Gas Journal.

A heavy feed such as a gas oil, vacuum gas oil is added to riser reactor 6 via feed injection nozzles 2. The cracking reaction is completed in the riser reactor, which takes a 90° turn at the top of the reactor at elbow 10. Spent catalyst and cracked products discharged from the riser reactor pass through riser cyclones 12 which efficiently separate most of the spent catalyst from cracked product. Cracked product is discharged into disengager 14, and eventually is removed via upper cyclones 16 and conduit 18 to the fractionator.

Spent catalyst is discharged down from a dipleg of riser cyclones 12 into catalyst stripper 8, where one, or preferably 2 or more, stages of steam stripping occur, with stripping steam admitted via lines 19 and 21. The stripped hydrocarbons, and stripping steam, pass into disengager 14 and are removed with cracked products after passage through upper cyclones 16.

Stripped catalyst is discharged down via spent catalyst standpipe 26 into catalyst regenerator 24. The flow of catalyst is controlled with spent catalyst plug valve 36.

This type of stripper design is one of the most efficient in modern FCC units, due in large part to its generous size. Most riser reactor FCC's have strippers disposed as annular beds about the riser reactor, and do not provide as much cross sectional area for catalyst flow as does the design shown in FIG. 1.

Catalyst is regenerated in regenerator 24 by contact with air, added via air lines and an air grid distributor not shown. A catalyst cooler 28 is provided so that heat may be removed from the regenerator, if desired. Regenerated catalyst is withdrawn from the regenerator via regenerated catalyst plug valve assembly 30 and discharged via lateral 32 into the base of the riser reactor 6 to contact and crack fresh feed injected via injectors 2, as previously discussed. Flue gas, and some entrained catalyst, are discharged into a dilute phase region in the upper portion of regenerator 24. Entrained catalyst is separated from flue gas in multiple stages of cyclones 4, and discharged via outlets 8 into plenum 20 for discharge to the flare via line 22.

Figure 2:
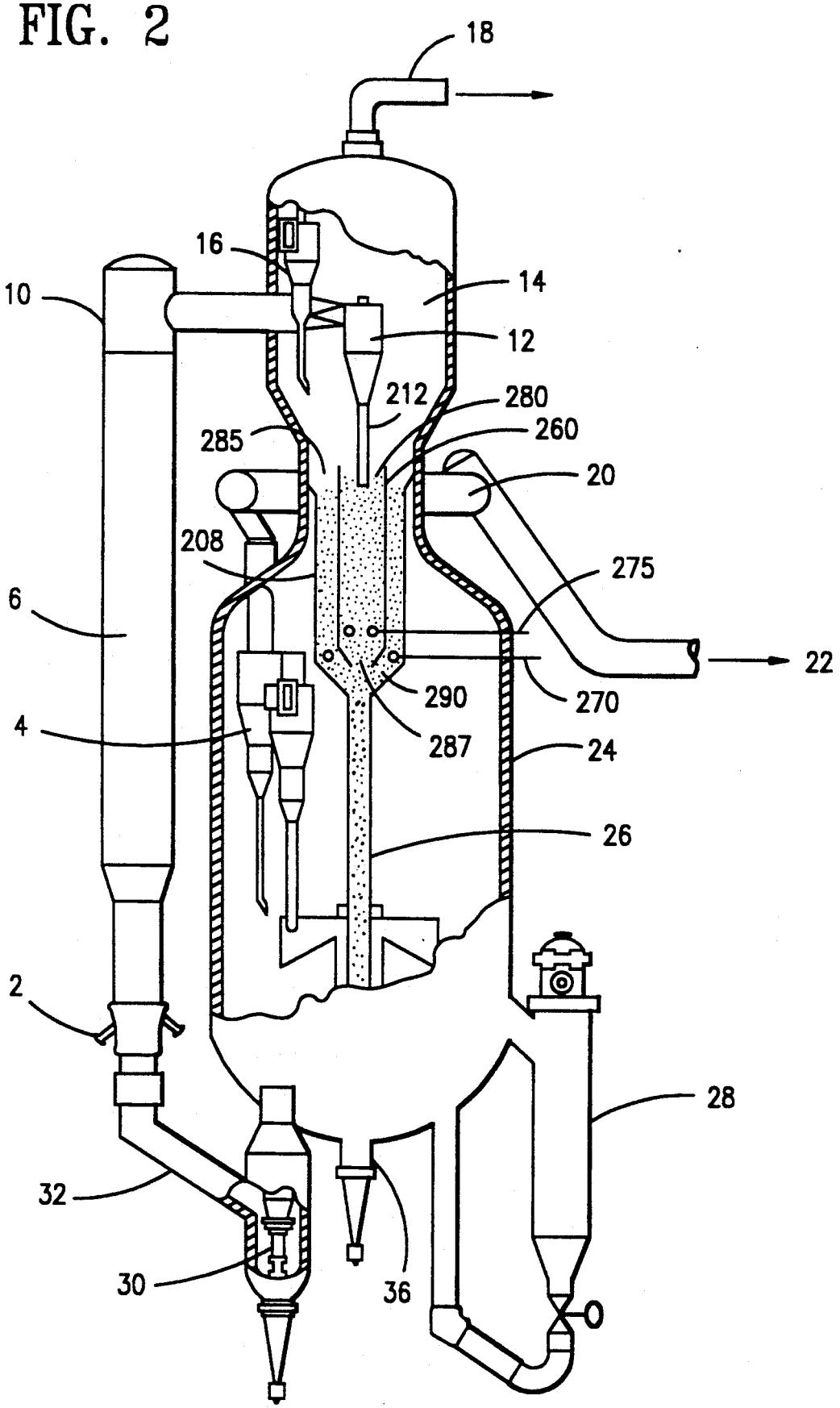
FIG. 2 (Invention) shows a fast fluid bed stripper disposed beneath the riser reactor outlet in an Orthoflow FCC.

In FIG. 2 (invention) most of the equipment is identical to the equipment used in the prior art design, FIG. 1. Like elements in FIG. 1 and 2 have like numerals. The riser reactor, and the regenerator can be identical.

A fast fluidized bed stripper 208 is added by providing an interior fast fluidized bed (FFB) region within vessel 260. Stripping steam is added via steam addition and distribution means 275 to a lower portion of the fast fluidized bed region, while spent catalyst is added via the primary spent catalyst/cracked product separation means, cyclone 12 in this instance. Preferably the dipleg 212 of the cyclone is sealed by immersion within inner vessel 260, although the design should also work if the dipleg 212 is sealed by conventional seal means such as a flapper valve, and discharges spent catalyst down into the FFB region.

The intense mixing, and good agitation characteristic in fast fluidized bed operation promote efficient contacting of spent catalyst with stripping steam. There are several flow patterns worthy of note in this stripping region. Preferably most of the spent catalyst is charged or initially dispersed within the FFB stripper, rather than on top of it as in conventional strippers. This can be achieved by sealing the dipleg 212 within the FFB region, or by relying on the momentum of the spent catalyst stream to carry it into the FFB region before its dispersion across the FFB region due to fluid forces. This results in a down and up flow for much of the spent catalyst.

There is preferably a significant amount of flow from within the FFB stripper down through the FFB stripper via outlet 287.

The FFB region is fairly small, open, and intense. It is characterized by high superficial vapor velocities. Such high velocities do not, however, result in undue catalyst entrainment above the stripper, save for a minor amount of entrainment just above region 280, where much of the catalyst overflows from the FFB region to the bubbling bed region 285. This is because in my design the total amount of stripping steam used may be similar to that of the prior art designs.

Vapor velocities are high in the FFB region, but the FFB region is relatively small. Vapor velocities in the bubbling bed region are lower, preferably lower than those characteristic of conventional strippers, and can be just enough to maintain good fluidization characteristics. With careful design of the unit, and close monitoring, it may be possible to eliminate entirely any flow of stripping steam or other fluidizing gas via line 290, relying instead on deaeration of well stripped catalyst overflowing region 280. Thus region 285 may function much like a standpipe under a conventional cyclone, and maintain dense phase fluidized flow even without any fluidizing gas. Most refiners will prefer to add some fluidizing gas, preferably steam, via gas inlet and distribution means 270. This is not done primarily for stripping, but rather to promote good flow of stripped catalyst via outlet 290 into the stripper standpipe 26.

The slight increase in catalyst entrainment or catalyst traffic just above the FFB region will not translate into increased catalyst entrainment in the upper portions of the vessel, near the entrance to the cyclone 16. This is because the superficial vapor velocity in the upper regions is dependent on total vapor flow, across the entire cross sectional area of the vessel, and the total amount of stripping steam can, in my process, be the same as or even less than that amount of stripping steam used in prior art processes. My process makes better use of stripping steam, rather than more of it.

Figure 3:
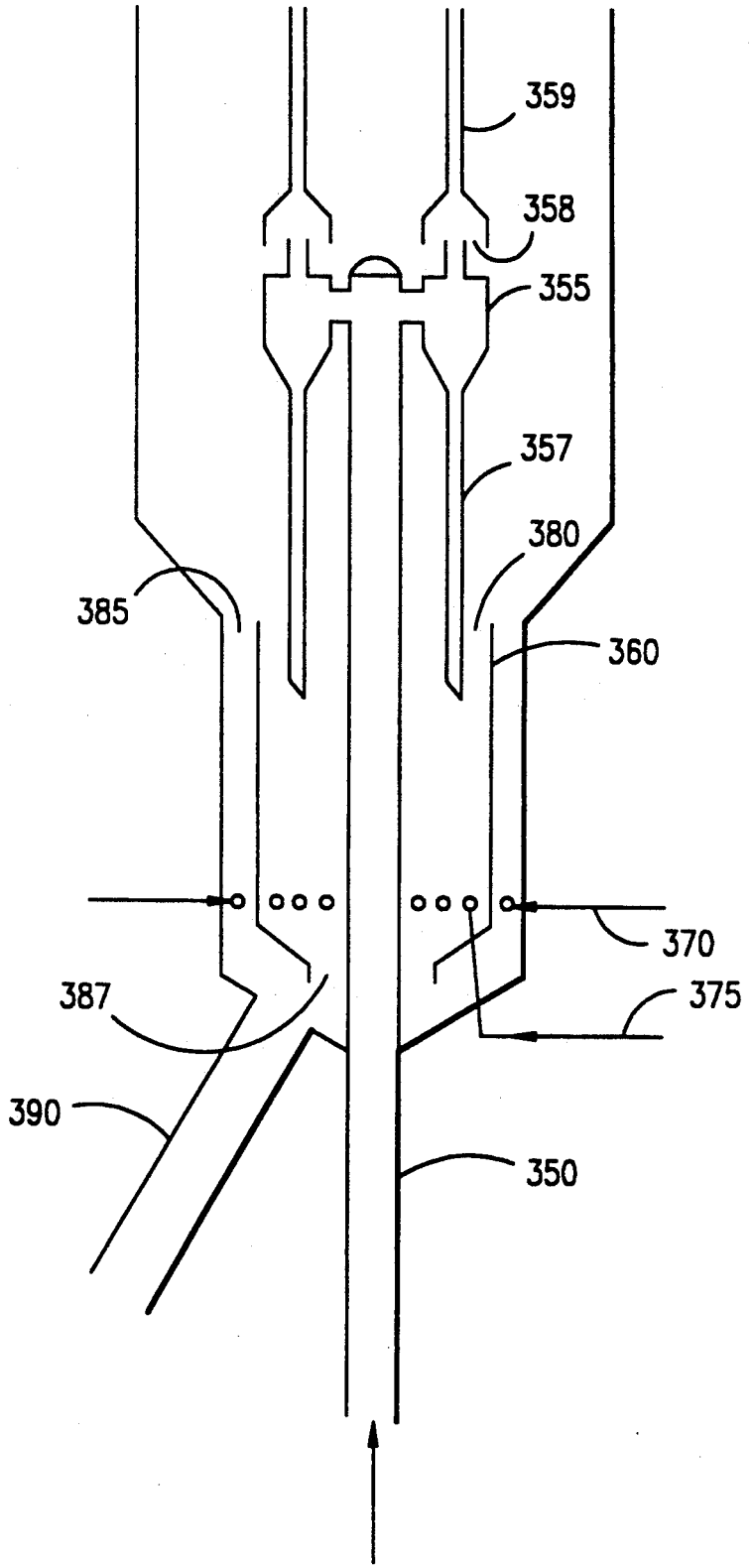
FIG. 3 (Invention) shows a preferred fast fluid bed stripper disposed as an annular bed about a riser reactor.

FIG. 3 shows another type of FCC unit, or at least the riser reactor portion. The regenerator is not shown, but it would be along side of the reactor rather than under the stripper as is shown in FIG. 1 and FIG. 2.

The heavy feed and regenerated catalyst are added by means not shown to the base of riser reactor 350. Cracked products are discharged from the top of the riser reactor into riser outlet cyclones 355, which quickly separate cracked products from spent catalyst. Cracked vapor products are removed from the reactor vessel via line 359, which usually passes through one or more stages of additional cyclone separation, not shown.

Spent catalyst is discharged down via a plurality of cyclone diplegs 357 into annular FFB stripping region defined by vessel 360, and the walls of the riser reactor 350. The chevron plates, or other packing used in conventional strippers are preferably not used here. Good stripping is achieved by forcing the stripper to operate at least in the turbulent fluidized bed mode, and preferably in the fast fluidized bed mode. Stripping steam is added via steam inlet and distribution means 375. Much of the catalyst overflows the FFB region via outlet 380 into bubbling dense bed region 385. Some of the catalyst exits the FFB region via annulus 387 in the base of the FFB region.

Stripped catalyst which overflows the FFB region passes via the bubbling dense bed region to the stripper outlet 390. Some fluidizing steam, or inert fluidizing gas such as nitrogen or flue gas, may be added via inlet and distribution means 370 to a lower portion of the bubbling bed region.

Now that the invention has been reviewed in connection with the embodiments shown in FIGS. 2 and 3, a more detailed discussion of the different parts or the process and apparatus of the present invention follows. Many elements of the present invention can be conventional, such as the cracking catalyst, so only a limited discussion of such elements is necessary.

FCC FEED

Any conventional FCC feed can be used. The process of the present invention is especially useful for processing difficult charge stocks, those with high levels of CCR material, exceeding 2, 3, 5 and even 10 wt %CCR. The process, especially when operating in a partial CO combustion mode, tolerates feeds which are relatively high in nitrogen content, and which otherwise might result in unacceptable NOx emissions in conventional FCC units.

The feeds may range from the typical, such as petroleum distillates or residual stocks, either virgin or partially refined, to the atypical, such as coal oils and shale oils. The feed frequently will contain recycled hydrocarbons, such as light and heavy cycle oils which have already been subjected to cracking.

Preferred feeds are gas oils, vacuum gas oils, atmospheric resids, and vacuum resids. The present invention is most useful when feeds contain more than 5, or more than 10 wt % material which is not normally distillable in refineries. Usually all of the feed will boil above 650° F., and 5 wt %, 10 wt % or more will boil above 1000° F.

FCC CATALYST

Any commercially available FCC catalyst may be used. The catalyst can be 100% amorphous, but preferably includes some zeolite in a porous refractory matrix such as silica-alumina, clay, or the like. The zeolite is usually 5–40 wt. % of the catalyst, with the rest being matrix. Conventional zeolites include X and Y zeolites, with ultra stable, or relatively high silica Y zeolites being preferred. Dealuminized Y (DEAL Y) and ultrahydrophobic Y (UHP Y) zeolites may be used. The zeolites may be stabilized with Rare Earths, e.g., 0.1 to 10 Wt % RE.

Relatively high silica zeolite containing catalysts are preferred for use in the present invention. They withstand the high temperatures usually associated with complete combustion of CO to CO2 within the FCC regenerator.

The catalyst inventory may also contain one or more additives, either present as separate additive particles or mixed in with each particle of the cracking catalyst. Additives can be added to enhance octane (shape selective zeolites, i.e., those having a Constraint Index of 1–12, and typified by ZSM-5, and other materials having a similar crystal structure), adsorb SOX (alumina), remove Ni and V (Mg and Ca oxides).

Most units will operate with a conventional inventory of FCC catalyst rather than with a mix of elutriable particles, for several reasons. Conventional FCC catalyst (whether fresh or equilibrium catalyst) is a staple article of commerce, readily available anywhere in the world. Most of the work on designing and running FCC units has been done with such particles. Also, many design problems can be avoided by using conventional sized particles, e.g., there is no concern that large particles of ZSM-5 will be trapped forever in the regenerator. Design and operation of the FFB stripper are also greatly simplified if the catalyst used has a conventional particle size distribution, with an average particle size of around 60–80 microns.

The FCC catalyst composition, per se, forms no part of the present invention.

FCC REACTOR CONDITIONS

Conventional FCC reactor conditions may be used. The reactor may be either a riser cracking unit or dense bed unit or both. Riser cracking is highly preferred. Typical riser cracking reaction conditions include catalyst/oil ratios of 0.5:1 to 15:1 and preferably 3:1 to 8:1, and a catalyst contact time of 0.5–50 seconds, and preferably 1–20 seconds, and riser top temperatures of 900° to 1200° F., preferably 950° to 1050° F.

The FCC reactor conditions, per se, are conventional and form no part of the present invention.

FAST FLUID BED CATALYST STRIPPING

Vigorous stripping, preferably stripping at vapor velocities sufficient to ensure turbulent fluidized bed stripping conditions, and most preferably fast fluidized bed stripping conditions is essential. Such stripping conditions can most easily be achieved and tolerated by using the stripper configuration shown in the figures, i.e., with cyclone diplegs sealed within, or just above, the inlet to the fast fluidized bed region.

Usually stripping steam will be used as the stripping medium, and usually in an amount, in the FFB region, roughly equal to that used in conventional strippers. The process of the present invention thus does not necessarily involve use of more steam, but rather makes better use of stripping steam.

Many units will operate with amounts of stripping vapor, expressed as wt % steam, in the FFB region equivalent to 0.5 to 10 wt % steam (based on the weight of fresh feed) preferably 1 to 6 wt % steam, and most preferably 1.5 to 4 wt % steam.

The superficial vapor velocity needed to achieve turbulent, and preferably fast fluidized bed conditions, will vary somewhat depending on the particular type of catalyst, the amount of metal contamination, particle size distribution of the catalyst (e.g., presence of sufficient fines for good fluidization), and many other factors. Despite the variables, in most units, superficial vapor velocities will need to exceed 3.0 feet per second (fps), and preferably will exceed 3.5 fps, most preferably above 4.0 fps. Optimum superficial vapor velocity in many units will be 5 to 10 fps.

FIG. 16 of Fluid Catalytic Cracking Report, Oil & Gas Journal, Jan. 8, 1990, which is incorporated by reference, shows a typical phase diagram of bed expansion for a modern FCC unit. Such figures can be generated for any catalyst used in any unit by resort to routine calculations or simple lab experiments. Refiners can easily recognize or calculate what kind of flow goes on in their strippers, and indeed have usually limited the amount of stripping steam added to prevent operation of their strippers in the turbulent or fast fluidized bed regime.

Preferably diplegs from riser reactor outlet cyclones are used to add at least 80% of the spent catalyst to the FFB region. Preferably a majority of the spent catalyst added overflows the FFB. It is possible for all of the catalyst to overflow from the FFB region, i.e., the base of the FFB region is sealed, but usually it will be preferably to allow from 2 to 20%, and most preferably from 4 to 10% of the catalyst to "drain" from the bottom of the FFB region.

Most or all of the stripping occurs in the FFB region, rather than in the bubbling dense bed stripping or flow region surrounding the FFB region. Preferably over 75% of the stripping occurs in the FFB region, more preferably at least 80%, and most preferably over 90%. Some additional stripping, ranging from just above 0 to approaching 50% may occur in the dense bed stripper.

The present invention can also be used to increase the effectiveness of hot strippers, e.g., those heated by recycling to the stripper hot, regenerated catalyst. In many instances, however, the improvement in stripping efficiency from operating in the fast fluidized bed regime will be so great that hot stripping will not be necessary.

CATALYST REGENERATION

The invention can benefit FCC units using any type of regenerator, ranging from single dense bed regenerators to the more modern, high efficiency designs. Some means to regenerate catalyst is essential, but the precise configuration of the regenerator is not critical.

Single, dense phase fluidized bed regenerators can be used, or multiple stage dense bed regenerators, or high efficiency regenerators.

FCC REGENERATOR CONDITIONS

The temperatures, pressures, oxygen flow rates, etc., are within the broad ranges of those heretofore found suitable for FCC regenerators, especially those operating with substantially complete combustion of CO to CO2 within the regeneration zone. Suitable and preferred operating conditions are:

| | Broad | Preferred |
|---|---|---|
| Temperature, °F. | 1100–1700 | 1150–1400 |
| Catalyst Residence Time, Seconds | 60–3600 | 120–600 |
| Pressure, atmospheres | 1–10 | 2–5 |
| % Stoichiometric, $O_2$ | 100–120 | 100–105 |

CO COMBUSTION PROMOTER

Use of a CO combustion promoter in the regenerator is not essential for the practice of the present invention, however, it is preferred. These materials are well-known.

U.S. Pat. No. 4,072,600 and U.S. Pat. No. 4,235,754, which are incorporated by reference, disclose operation of an FCC regenerator with minute quantities of a CO combustion promoter. From 0.01 to 100 ppm Pt metal or enough other metal to give the same CO oxidation, may be used with good results. Very good results are obtained with as little as 0.1 to 10 wt. ppm platinum present on the catalyst in the unit. In swirl type regenerators, operation with 1 to 7 ppm Pt commonly occurs. Pt can be replaced by other metals, but usually more metal is then required. An amount of promoter which would give a CO oxidation activity equal to 0.3 to 3 wt. ppm of platinum is preferred.

Conventionally, refiners add CO combustion promoter to promote total or partial combustion of CO to CO2 within the FCC regenerator. More CO combustion promoter can be added without undue bad effect—the primary one being the waste of adding more CO combustion promoter than is needed to burn all the CO.

Catalyst coolers may be used, if desired. Such devices are very useful, especially when processing heavy feeds, but many units operate without them. In general, there will be less need for catalyst coolers when practicing my invention, because more efficient stripping of catalyst reduces the amount of fuel (unstripped hydrocarbons) that must be burned in the regenerator. Better stripping also reduces the steam partial pressure in the regenerator (by removing more of the hydrogen rich "fast coke" on spent catalyst in the stripper) so the catalyst can tolerate somewhat hotter regenerator temperatures. Thus the regenerator will usually be able to operate cooler and dryer with a fast fluidized bed stripper, while permitting higher temperature operation without excessive catalyst deactivation, so catalyst coolers will be harder to justify.

DISCUSSION

My invention demands an unusual stripping operation.

In conventional (prior art) strippers, cyclone diplegs (if used at all) usually discharge spent catalyst catalyst above the stripper. This "top entry" was thought essential for counter-current stripping. The stripper operated at a restricted superficial vapor velocity, to minimize displacement of catalyst from the stripper to the dilute phase region above the stripper. All catalyst exited the bottom of the stripper, again to achieve counter-current stripping. This approach, while theoretically sound, put so many constraints on stripper operation that poor results were invariably achieved in commercial use.

In contrast, I prefer to add most or all of the spent catalyst inside the stripper, by virtue of discharge of spent catalyst from cyclone diplegs immersed in the stripper bed.

Rather than limit stripper superficial velocity to minimize entrainment, my stripper vapor velocity is set high enough to entrain most of the catalyst out of the top of the stripper. A minor amount of spent catalyst still receives counter-current stripping, that catalyst removed from the bottom of the stripper, while most of the spent catalyst receives only a single vigorous stage of co-current stripping in passing from the cyclone dipleg and then over the top of the stripper.

If desired, additional stripping can easily be achieved in an annular secondary stripper surrounding the FFB stripper. Such additional stripping should be at a relatively low vapor velocity.

The process and apparatus of the present invention allow refiners to improve the last great region of inefficiency remaining in FCC processing. Refiners have been plagued with strippers which left large amounts of potentially recoverable product on the spent catalyst, in some cases, ⅓ up to almost ½ of the "coke" was potentially recoverable product. Refiners now can make less coke, and more product, operate their units more efficiently, and without undue capital expense, and usually with no incremental operating expense.

The benefits are an immediate increase in the amount of liquid product recovered, a reduction in regenerator air blower duty, increased catalyst life due both to a cooler regenerator and to a drier regenerator, and increased conversion due to "winding up" the unit by increasing catalyst circulation to maintain a constant riser top temperature with cooler catalyst.

What is claimed is:

1. A fluidized catalytic cracking process wherein a heavy hydrocarbon feed comprising hydrocarbons having a boiling point above about 650° C. is catalytically cracked to lighter products by contact with a circulating fluidizable catalytic cracking catalyst inventory consisting of particles having a size ranging from about 20 to about 100 microns, and fines, cracked catalyst particles having a smaller particle size, comprising:

a. catalytically cracking said feed in a catalytic cracking reactor operating at catalytic cracking conditions by contacting feed with a source of regenerated catalyst to produce a cracking reactor effluent mixture comprising cracked products and spent catalyst containing coke and strippable hydrocarbons;

b. separating said effluent mixture in a separation means into a cracked product rich vapor phase and a solids rich phase comprising spent catalyst;

c. discharging at least 80% of said solids rich phase down into a fast fluidized bed (FFB) stripping means having an opening and opening cross sectional area at a top portion thereof for admission of spent catalyst and an opening at a base portion thereof for stripping gas, said stripping means operating at stripping conditions including a superficial vapor velocity above 3.0 fps and sufficient to displace at least a majority of solids discharged down into said stripping zone back up from said stripping zone into a stripped catalyst transport region alongside of said FFB stripping means, to produce:

a stripper vapor phase which is discharged up from said FFB stripping means with said solids discharged up from said stripping zone, and stripped catalyst, at least a majority of which is discharged upon from said stripping zone;

d. transporting said stripped catalyst via said transport region to a catalyst regeneration means;

e. regenerating said stripped catalyst in a catalyst regeneration means to produce regenerated catalyst; and f. recycling said regenerated catalyst to said catalytic cracking reactor.

2. The process of claim 1 wherein 50 to 95% of stripped catalyst discharged from said stripper is discharged up, and 5 to 50% is discharged down via a stripped catalyst outlet in a lower portion of said stripper.

3. The process of claim 1 wherein said stripper vapor phase is combined with said cracked product vapor phase.

4. The process of claim 1 wherein superficial vapor velocity in said stripper is above 4.0 fps.

5. The process of claim 1 wherein the superficial vapor velocity in said stripper is from 5 to 10 fps.

6. The process of claim 1 wherein the stripping conditions, and particle sizes of said circulating catalyst inventory are sufficient to prevent particle elutriation in said stripper.

7. The process of claim 6 wherein the circulating catalyst inventory consists essentially of particles having an average particle size within the range of 20–90 microns and catalyst fines.

8. The process of claim 1 wherein said transport means is disposed as an annulus about said stripping means.

9. The process of claim 8 wherein additional amount of stripping gas are added to said annulus.

10. A fluidized catalytic cracking process wherein a heavy hydrocarbon feed comprising hydrocarbons having a boiling point above about 650° F. is catalytically cracked to lighter products by contact with a fluidizable catalytic cracking catalyst consisting of particles having a size ranging from about 20 to about 100 microns, and fines and cracked catalyst particles having a smaller particle size, comprising:

a. catalytically cracking said feed in a riser catalytic cracking reactor operating at catalytic cracking conditions by contacting feed with a source of regenerated catalyst in the base of said riser reactor and discharging from a top portion of said riser reactor cracked products and spent catalyst containing coke and strippable hydrocarbons into a riser cyclone separation means within a vessel and connective with said riser outlet;

b. separating said effluent mixture in said riser cyclone means into a cracked product rich vapor phase and a solids rich phase comprising spent catalyst and strippable hydrocarbons which is discharged down via a cyclone dipleg means sealed by immersion within a fast fluidized bed stripping means;

c. fast fluidized bed (FFB) stripping of said spent catalyst and strippable hydrocarbons discharged from said riser cyclone dipleg means in a FFB stripping means within said vessel and beneath said riser cyclone means and encompassing said riser cyclone dipleg means, at FFB stripping conditions including sufficient stripping steam to generate a superficial vapor velocity above 3.0 fps, and sufficient to both strip spent catalyst and displace at lest 50 wt % of the spent catalyst discharged via said dipleg means from said FFB stripping means up and over from said FFB stripping means into a bubbling bed stripping means alongside of said FFB stripping means to produce:

a FFB stripper vapor phase which is discharged up from said FFB stripping means with said displaced, stripped catalyst, at a superficial vapor velocity at a top portion of said FFB stripper of at least 3.0 fps;

a FFB stripped catalyst product, consisting of at least 50 wt % of said spent catalyst, which is discharged up from said FFB stripping means and which overflows into said bubbling bed stripping means;

d. bubbling bed stripping of stripped catalyst discharged up from said FFB stripping means at bubbling bed stripping conditions including a superficial vapor velocity below 2.5 fps to produce a stream of catalyst which has been stripped at both FFB stripping conditions and at bubbling bed stripping conditions, which is discharged down from said bubbling bed stripping means via a bubbling bed stripper lower outlet;

e. combining in a shared vapor region above said FFB stripping means and said bubbling bed stripping means vapors from said stripping means and passing said combined stripper vapors through an enlarged region of said vessel above said stripping means, having an increased cross sectional area for flow sufficient to reduce the superficial vapor velocity of the combined streams to below 2.0 fps, and combining in said upper portion of said vessel stripper vapors and cracked product vapor;

f. regenerating stripped catalyst removed from the bottom of said bubbling bed stripper in a catalyst regeneration means to produce regenerated catalyst; and g. recycling said regenerated catalyst to said catalytic cracking reactor.

11. The process of claim 10 wherein 50 to 90% of stripped catalyst discharged from said stripper is discharged up, and the remainder is discharged down via a stripped catalyst outlet in a lower portion of said stripper.

12. The process of claim 10 wherein said stripper vapor phase is combined with said cracked product vapor phase.

13. The process of claim 1 wherein superficial vapor velocity in said stripper is above 4.0 fps.

14. The process of claim 10 wherein the superficial vapor velocity in said stripper is from 5 to 10 fps.

15. The process of claim 10 wherein the stripping conditions, and particle sizes of said circulating catalyst inventory are sufficient to prevent particle elutriation in said stripper.

16. The process of claim 15 wherein the circulating catalyst inventory consists essentially of particles having an average particle size within the range of 20–90 microns and catalyst fines.

17. The process of claim 10 wherein said transport means is disposed as an annulus about said stripping means.

18. The process of claim 10 wherein said superficial vapor velocity in said FFB stripper is at least 4.0 fps and said superficial vapor velocity in said upper portion of said vessel is less than 1.5 fps.

19. The process of claim 10 wherein said superficial vapor velocity in said FFB stripper is 5 to 10 fps.

* * * * *

UNITED STATES PATENT AND TRADEMARK OFFICE

CERTIFICATE OF CORRECTION

PATENT NO. : 5,284,575

DATED : February 8, 1994

INVENTOR(S) : Hartley Owen

It is certified that error appears in the above-identified patent and that said Letters Patent is hereby corrected as shown below:

Column 13, line 15, "650°C" should read --650°F--.
Column 13, line 47,"upon" should read --up--.
Column 14, line 44, "lest" should read --least--.

Signed and Sealed this

Twenty-first Day of June, 1994

Bruce Lehman

*Attest:*

BRUCE LEHMAN

*Attesting Officer*

*Commissioner of Patents and Trademarks*